US009964067B2

(12) United States Patent
Mehring et al.

(10) Patent No.: US 9,964,067 B2
(45) Date of Patent: May 8, 2018

(54) INTERNAL COMBUSTION ENGINE WITH OIL CIRCUIT AND OIL-LUBRICATED SHAFT BEARINGS

(71) Applicant: FORD GLOBAL TECHNOLOGIES, LLC, Dearborn, MI (US)

(72) Inventors: Jan Mehring, Cologne (DE); Stefan Quiring, Leverkusen (DE); Bernd Steiner, Bergisch Gladbach (DE); Hans Guenter Quix, Herzogenrath (DE); Moritz Klaus Springer, Hagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 95 days.

(21) Appl. No.: 14/731,230

(22) Filed: Jun. 4, 2015

(65) Prior Publication Data

US 2016/0003186 A1 Jan. 7, 2016

(30) Foreign Application Priority Data

Jul. 3, 2014 (DE) ..... 10 2014 212 903

(51) Int. Cl.
*F02F 1/10* (2006.01)
*F02F 7/00* (2006.01)
(Continued)

(52) U.S. Cl.
CPC ..... *F02F 7/0053* (2013.01); *F01M 5/021* (2013.01); *F02F 1/14* (2013.01); *F02M 26/00* (2016.02);
(Continued)

(58) Field of Classification Search
CPC ..... F02F 7/0053; F16C 9/02
(Continued)

(56) References Cited

U.S. PATENT DOCUMENTS 3,824,579 A * 7/1974 Waseleski, Jr. ..... G01K 1/024 200/DIG. 13
4,651,691 A * 3/1987 Ogawa ..... F02F 7/0053 123/195 H
(Continued)

FOREIGN PATENT DOCUMENTS

DE 3322063 A1 12/1984
DE 3322063 C2 11/1985
(Continued)

OTHER PUBLICATIONS

German Office Action for corresponding Application No. 10 2014 212 903.6, dated Jan. 19, 2015, 7 pages.
(Continued)

*Primary Examiner* — Marguerite McMahon
*Assistant Examiner* — James Kim
(74) *Attorney, Agent, or Firm* — Brooks Kushman P.C.; Greg Brown

(57) ABSTRACT

An internal combustion engine includes a cylinder head, a cylinder block serving as an upper crankcase half for holding a crankshaft in at least two crankshaft bearings, at least one further shaft mounted in at least two shaft bearings, an oil circuit with oil-conducting lines for supplying oil to at least two bearings, and an exhaust-gas recirculation arrangement. A heat conductor runs between at least one of the bearings and a thermally more highly loaded region of the internal combustion engine which, at least in the warm-up phase of the internal combustion engine, is at a higher temperature than the associated bearing.

16 Claims, 2 Drawing Sheets

(51) Int. Cl.

| | |
|---|---|
| ***F02F 1/14*** | (2006.01) |
| ***F02M 26/00*** | (2016.01) |
| ***F01M 5/02*** | (2006.01) |
| *F02M 26/41* | (2016.01) |
| *F01M 11/02* | (2006.01) |

(52) U.S. Cl.
CPC ..... *F01M 2011/026* (2013.01); *F02M 26/41* (2016.02)

(58) Field of Classification Search
USPC ..... 123/41.72, 195 R, 90.1
See application file for complete search history.

(56) References Cited

U.S. PATENT DOCUMENTS 4,729,349 A * 3/1988 Sonoda ..... F01L 1/053 123/196 R
4,922,870 A * 5/1990 Pietsch ..... F02F 7/0053 123/195 H
5,072,146 A * 12/1991 New ..... F16C 32/0442 310/214
5,186,129 A * 2/1993 Magnan ..... F01L 1/047 123/90.33
6,192,107 B1 * 2/2001 Price ..... H01J 35/106 378/125
6,373,394 B1 4/2002 Zhang
2009/0020263 A1 1/2009 Ohsawa et al.
2012/0073284 A1 3/2012 Chen et al.

FOREIGN PATENT DOCUMENTS

DE 112007000222 T5 11/2008
JP 2013036435 A 2/2013
JP 2013108387 A 6/2013

OTHER PUBLICATIONS

Verein Deutscher Ingenieure, "VDI-Warmeatlas", Springer-Verlag Berlin Heidelberg, Germany, 2006, 7 pages.
Wang et al., "Development of a New Engine Piston Incorporating Heat Pipe Cooling Technology", SAE International, Abstract of Paper #950521, Feb. 1, 1995, 2 pages.

* cited by examiner

INTERNAL COMBUSTION ENGINE WITH OIL CIRCUIT AND OIL-LUBRICATED SHAFT BEARINGS

CROSS-REFERENCE TO RELATED APPLICATIONS

This application claims foreign priority benefits under 35 U.S.C. § 119(a)-(d) to DE10 2014 212 903.6, filed Jul. 3, 2014, which is hereby incorporated by reference in its entirety.

TECHNICAL FIELD

Various embodiments relate to an internal combustion engine with a block serving as an upper crankcase half for holding a crankshaft in at least two crankshaft bearings, at least one further shaft which is mounted in at least two shaft bearings, and an oil circuit, with oil-conducting lines, for supplying oil to the two bearings.

BACKGROUND

An internal combustion engine is used as a drive for motor vehicles. Within the context of the present disclosure, the expression "internal combustion engine" encompasses Otto-cycle engines and diesel engines but also hybrid internal combustion engines, which utilize a hybrid combustion process, and hybrid drives which comprise not only the internal combustion engine but also an electric machine which is connectable in terms of drive to the internal combustion engine and which receives power from the internal combustion engine or which, as a switchable auxiliary drive, outputs power in addition.

Internal combustion engines have a cylinder block and at least one cylinder head which can be or are connected to one another in order to form the individual cylinders, that is to say combustion chambers. The individual components are discussed briefly below.

To hold the pistons or the cylinder liners, the cylinder block has a corresponding number of cylinder bores. The piston of each cylinder of an internal combustion engine is guided in an axially movable manner in a cylinder liner and, together with the cylinder liner and the cylinder head, delimits the combustion chamber of a cylinder. Here, the piston crown forms a part of the combustion chamber inner wall, and, together with the piston rings, seals off the combustion chamber with respect to the cylinder block or the crankcase, such that no combustion gases or no combustion air pass(es) into the crankcase, and no oil passes into the combustion chamber.

The pistons serve to transmit the gas forces generated by combustion to the crankshaft. For this purpose, each piston is articulatedly connected by means of a piston pin to a connecting rod, which in turn is movably mounted on the crankshaft.

The crankshaft is mounted in the crankcase and absorbs the connecting rod forces, which are composed of the gas forces as a result of the fuel combustion in the combustion chamber and the mass forces as a result of the non-uniform movement of the engine parts. Here, the oscillating stroke movement of the pistons is transformed into a rotating rotational movement of the crankshaft. The crankshaft transmits the torque to the drivetrain. A part of the energy transmitted to the crankshaft is used for driving auxiliary units such as the oil pump and the alternator, or serves for driving the camshaft and therefore for actuating the valve drive.

Generally, and within the context of the present disclosure, the upper crankcase half is formed by the cylinder block. The crankcase is completed by the lower crankcase half which can be mounted on the upper crankcase half and which serves as an oil pan. Here, to hold the oil pan, that is to say the lower crankcase half, the upper crankcase half has a flange surface. In general, to seal off the oil pan or the crankcase with respect to the environment, a seal is provided in or on the flange surface. The connection is often provided by means of screws.

To hold and mount the crankshaft, at least two bearings are provided in the crankcase, which bearings are generally of two-part design and comprise in each case one bearing saddle and one bearing cover which can be connected to the bearing saddle. The crankshaft is mounted in the region of the crankshaft journals which are arranged spaced apart from one another along the crankshaft axis and are generally formed as thickened shaft shoulders. Here, bearing covers and bearing saddles may be formed as separate components or in one piece with the crankcase, that is to say with the crankcase halves. Bearing shells may be arranged as intermediate elements between the crankshaft and the bearings.

In the assembled state, each bearing saddle is connected to the corresponding bearing cover. In each case one bearing saddle and one bearing cover—if appropriate in interaction with bearing shells as intermediate elements—form a bore for holding a crankshaft journal. The bores are conventionally supplied with engine oil, that is to say lubricating oil, such that a load-bearing lubricating film is ideally formed between the inner surface of each bore and the associated crankshaft journal as the crankshaft rotates—similarly to a plain bearing. Alternatively, a bearing may also be formed in one piece, for example in the case of a composite crankshaft.

To supply the crankshaft bearings with oil, a pump for delivering engine oil to the at least two crankshaft bearings is provided, with the pump supplying engine oil via a supply line to a main oil gallery, from which ducts lead to the at least two bearings.

To form the so-called main oil gallery, a main supply duct is often provided which is aligned along the longitudinal axis of the crankshaft. The main supply duct may be arranged above or below the crankshaft in the crankcase or else at the same level, in particular may be integrated into the crankshaft.

The oil-conducting lines of the oil circuit lead through the cylinder block and, if appropriate, through the cylinder head, may also emerge from and re-enter the block and/or head several times, and may, alternatively or in addition to the crankshaft bearings, supply oil to further bearings, for example the bearings of a camshaft, which is generally mounted in a two-part so-called camshaft receptacle. The statements already made above with regard to the crankshaft bearing arrangement apply analogously. The camshaft receptacle must normally also be supplied with lubricating oil, for which purpose a supply line must be provided which, in the case of overhead camshafts, extends into the cylinder head and, according to the prior art, is commonly connected to the main oil gallery and leads through the cylinder block.

Further bearings may for example be the bearings of a connecting rod or the bearings of a balancing shaft which may be provided if appropriate.

The friction in the bearings to be supplied with oil, for example, the bearings of the crankshaft, is dependent significantly on the viscosity and therefore the temperature of the oil which is provided, and said friction contributes to the fuel consumption of the internal combustion engine.

It is fundamentally sought to minimize fuel consumption. In addition to improved, that is to say more effective, combustion, the reduction of friction losses is also in the foreground of the efforts being made. Moreover, a reduced fuel consumption also contributes to a reduction in pollutant emissions.

With regard to reducing friction losses, rapid heating of the engine oil and fast heating-up of the internal combustion engine, in particular after a cold start, is expedient. Fast heating of the engine oil during the warm-up phase of the internal combustion engine ensures a correspondingly fast decrease in viscosity, and therefore a reduction in friction and friction losses, in particular in the bearings which are supplied with oil.

The prior art discloses concepts in which the oil is actively heated by means of a heating device after a cold start. The heating device itself however in turn consumes fuel and thus contributes, in a counterproductive manner, to increased fuel consumption. In other concepts, the engine oil which is heated during operation is stored in an insulated container, such that already-heated oil is available in the event of a re-start of the internal combustion engine. A disadvantage of the latter approach is that the oil which is heated during operation cannot be kept at a high temperature indefinitely, for which reason re-heating of the oil is usually necessary during the warm-up phase of the internal combustion engine.

With regard to the reduction of friction losses, it must be taken into consideration that the oil additionally has heat extracted from it as it flows through the crankcase, which immediately after a cold start has not yet warmed up, such that the heating of the oil cannot be expedient on its own without further measures.

Even if, after a cold start, the oil is heated by means of a heating device or is delivered, in the already-heated state, out of an insulated container, the hot oil cools again on the path to the bearings in the oil-conducting lines of the oil circuit owing to the fact that the engine structure has not yet heated up, such that oil available or made available at the bearings is not noticeably warmer.

SUMMARY

Against the background of that stated above, an object of the present disclosure to provide an internal combustion engine which is optimized with regard to friction losses.

According to an embodiment, an internal combustion engine is provided with at least one cylinder head with at least one cylinder, and at least one cylinder block. The cylinder block is connected to the at least one cylinder head and serves as an upper crankcase half, for holding a crankshaft in at least two crankshaft bearings. The engine includes at least one further shaft mounted in at least two shaft bearings, and an oil circuit including oil-conducting lines, for supplying oil to at least two bearings, and an exhaust-gas recirculation arrangement.

The engine is also provided with at least one heat conductor which runs between at least one bearing and at least one thermally more highly loaded region of the internal combustion engine which, at least in the warm-up phase of the internal combustion engine, is at a higher temperature than the at least one bearing.

The internal combustion engine according to the various embodiments of the disclosure has at least one heat conductor which introduces heat into at least one bearing which is to be supplied with and lubricated by oil. In this case, the heat is preferably introduced not directly into the oil situated in the bearing but rather into the bearing saddle and/or the bearing cover or into a bearing shell which serves as intermediate element. The oil itself is then heated indirectly via the structure which forms the bearing.

A thermally more highly loaded region of the internal combustion engine, that is to say a region which is thermally more highly loaded than the associated bearing, heats up more quickly than the associated bearing in the warm-up phase and is thus at a higher temperature than the associated bearing at least during the warm-up phase, and serves as a heat source. Driven by the temperature difference between the thermally more highly loaded region and the bearing which is to be supplied with heat, heat passes from a relatively hot region of the internal combustion engine to and into the bearing and thus into the oil.

Owing to the heat conductor according to the various embodiments of the disclosure, the oil in the bearing heats up more quickly after a cold start. The hotter oil has a lower viscosity and leads to a reduction in friction losses of the bearing. As a result, the fuel consumption of the internal combustion engine is reduced by means of the heat conductor, in particular after a cold start.

According to various embodiments, use is made of the fact that the internal combustion engine has regions which heat up more quickly during the warm-up phase than the at least one bearing or than the oil situated in the bearing.

An oil at relatively high temperature heated by means of a heating device or delivered out of an insulated container would cool down to a great extent on the path to the bearing in the oil-conducting lines of the oil circuit, such that oil available or made available at the bearing is not noticeably warmer. According to various embodiments of the invention, the heat is introduced and made available in targeted fashion at the location where it is required, specifically in the bearing itself by means of the heat conductor.

The internal combustion engine according to various embodiments of the invention achieves an object of providing an internal combustion engine which is optimized with regard to friction losses.

Embodiments of the internal combustion engine are advantageous in which a pump for delivering the oil is provided in the oil circuit, in which the pump is connected via a supply line to a main oil gallery from which ducts lead to the at least two crankshaft bearings.

Embodiments of the internal combustion engine are advantageous in which an oil pan which can be mounted on the upper crankcase half and which serves as a lower crankcase half is provided for collecting the engine oil, and the pump delivers engine oil originating from the oil pan via a supply line to the main oil gallery.

In said embodiment, the crankcase is formed in two parts, with the upper crankcase half being completed by an oil pan in which the returned oil is collected. The oil pan may be equipped on the outside with cooling fins or stiffening ribs and is preferably produced from sheet metal in a deep drawing process, whereas the upper crankcase half is preferably a cast part.

In designing and constructing the crankcase, it is a basic aim to obtain the greatest possible level of rigidity in order to reduce vibrations, that is to say oscillations, and to thereby favorably influence noise generation and noise emissions.

Furthermore, the crankcase, which is of modular design, may be constructed in such a way that the machining of the assembly and sealing surfaces and also the assembly can take place in the simplest possible manner in order to reduce costs.

Further embodiments of the internal combustion engine are advantageous in which the at least one bearing comprises bearing shells. The bore formed by the bearing shells is supplied with oil, wherein the inner surface of the bore forms a plain bearing.

Embodiments of the internal combustion engine are advantageous in which the at least one bearing is a rolling bearing. Aside from the rolling bodies, a rolling bearing comprises an outer and an inner ring, which form a cage in which the rolling bodies are movably mounted. It is then preferably the case that the heat conductor serves for introducing heat into the outer ring and indirectly into the oil.

Embodiments of the internal combustion engine are advantageous in which the at least one further shaft is a camshaft which is mounted in the cylinder head in at least two bearings. Reference is made to the statements made at the outset.

Embodiments of the internal combustion engine are advantageous in which the at least one further shaft is a balancing shaft which is mounted in at least two bearings.

The mass forces arising from the non-uniform movement of the engine parts require mass balancing. The oscillating components in particular necessitate comprehensive measures for balancing the mass forces, specifically the arrangement of balancing shafts and the mounting and drive thereof, whereas the mass forces arising from rotating masses can be easily balanced by way of counterweights or imbalances arranged on the crankshaft.

For this reason, a support structure is often provided in the crankcase, which support structure bears the at least one balancing shaft for the balancing of the mass forces.

Embodiments of the internal combustion engine are advantageous in which the thermally more highly loaded region is a region of the at least one cylinder head.

In this case, embodiments of the internal combustion engine are advantageous in which the at least one heat conductor comprises material which exhibits higher thermal conductivity than the at least one cylinder head.

In this connection, it is taken into consideration that the cylinder head and also the cylinder block of a modern internal combustion engine are thermally highly loaded components and heat up relatively quickly during the warm-up phase, that is to say are suitable as a heat source within the context of the concept according to various embodiments of the invention.

Embodiments of the internal combustion engine may therefore likewise be advantageous in which the thermally more highly loaded region is a region of the cylinder block.

In this case, embodiments of the internal combustion engine are advantageous in which the at least one heat conductor comprises material which exhibits higher thermal conductivity than the cylinder block.

In the case of internal combustion engines which comprise an exhaust-gas discharge system for discharging the exhaust gas from the at least one cylinder, embodiments are advantageous in which the thermally more highly loaded region is a region of the exhaust-gas discharge system.

In this case, embodiments of the internal combustion engine are advantageous in which the at least one heat conductor comprises material which exhibits higher thermal conductivity than the exhaust-gas discharge system.

The exhaust-gas discharge system heats up relatively quickly even after a cold start. The exhaust line which connects to the outlet opening of a cylinder is at least partially integrated in the cylinder head and is merged together with other exhaust lines to form a common overall exhaust line, or else in groups to form two or more overall exhaust lines.

Exhaust manifolds are increasingly commonly integrated into the cylinder head in order to benefit from a liquid-type cooling arrangement which may be provided in the cylinder head and in order that the manifolds need not be produced from thermally highly loadable materials, which are expensive. Furthermore, the distance from the outlet opening of the cylinder to an exhaust-gas aftertreatment system provided in the exhaust-gas discharge system, or to a turbine provided in the exhaust-gas discharge system, is shortened.

The fact that the exhaust-gas discharge system is a thermally highly loaded component has proven to be advantageous in the present case. The heat conductor preferably starts at a manifold section which is integrated in the cylinder head, such that, firstly, the cylinder head material functions as a load-bearing structure, and, secondly, the heat of the exhaust gas can be utilized. Furthermore, the distance that must be covered from the heat conductor to the bearing is shortened.

Embodiments of the internal combustion engine are advantageous in which the thermally more highly loaded region is a region of the exhaust-gas recirculation (EGR) arrangement. In this case, the exhaust-gas recirculation arrangement may run externally, that is to say outside the cylinder head, or else through the cylinder head, such that the thermally more highly loaded region may be a region of the exhaust-gas recirculation arrangement and simultaneously a region of the cylinder head.

In the case of internal combustion engines with at least two cylinders, embodiments are advantageous in which the thermally more highly loaded region is a region between the at least two cylinders. The region between two cylinders is subjected to particularly high thermal load. The bore bridge formed at this location heats up quickly and exhibits high temperatures. In principle, the heat can be dissipated from there only with difficulty, wherein the surface formed by the combustion chamber inner walls of the cylinders for heat transfer into the bridge is large and is exposed to the hot exhaust gas for a relatively long time.

Embodiments of the internal combustion engine are advantageous in which the at least one heat conductor is a thermal tube.

A thermal tube is a heat exchanger which, utilizing the heat of evaporation of a medium, permits a high heat flux density. Large amounts of heat can be transported via small cross-sectional areas. A distinction can be made between two types of thermal tube, specifically the heatpipe and the two-phase thermosiphon. The functional principle of both types is the same, wherein the difference exists in the transportation of the medium that is used. The advantage of a thermal tube is that no additional transportation means, for example a delivery pump, is required.

Thermal tubes comprise a volume of a working medium, for example water or ammonia, which is preferably hermetically encapsulated in pipes, wherein a small part of the volume of the working medium is present in the liquid state and a relatively large part is present in the vapor state. When heat is introduced, the working medium begins to evaporate. In this way, the pressure on the liquid part is increased, forming a small pressure gradient within the thermal tube. The vapor that is generated flows in the direction of a condenser, at which the vapor condenses and releases the previously absorbed heat again. The liquid working medium returns to an evaporator under the action of gravity in the case of the thermosiphon and by way of capillary action in the case of the heatpipe. The evaporator is located at the heat source, whereas the condenser should, according to the disclosure, be provided at the bearing side.

The thermal resistance of a thermal tube is considerably lower than that of metals. An approximately constant temperature prevails over the length of the thermal tube, such that transfer losses are virtually negligible. For the same transfer capacity, therefore, thermal tubes can also be dimensioned to be smaller than metal conductors.

Nevertheless, embodiments of the internal combustion engine may be advantageous in which the heat conductor is a metal conductor.

Embodiments of the internal combustion engine are advantageous in which a coolant-conducting liquid-type cooling arrangement is provided.

The heat released during the combustion by the exothermic, chemical conversion of the fuel is dissipated partially to the cylinder head and cylinder block via the walls which delimit the combustion chamber and partially to the adjacent components and the environment via the exhaust-gas flow. To keep the thermal loading within limits, a part of the heat flow introduced into the cylinder head or cylinder block must often be discharged in a targeted fashion by cooling.

On account of the significantly higher heat capacity of liquids in relation to air, it is possible for significantly greater quantities of heat to be dissipated using a liquid-type cooling arrangement than using an air-type cooling arrangement. The formation of a liquid-type cooling arrangement necessitates that the head and/or block be equipped with a coolant jacket, that is to say necessitates the provision of coolant ducts which conduct the coolant through the head and/or block. The heat does not need to be conducted to the surface in order to be dissipated. The heat is dissipated to the coolant already in the interior. Here, the coolant is fed by means of a pump arranged in the cooling circuit, such that said coolant circulates in the coolant jacket. The heat dissipated to the coolant is discharged from the interior of the head or block in this way, and is extracted from the coolant again in a heat exchanger.

In this context, embodiments of the internal combustion engine are advantageous in which the at least one cylinder head is equipped with at least one integrated coolant jacket for forming a liquid-type cooling arrangement.

Embodiments of the internal combustion engine are also advantageous in which the cylinder block is equipped with at least one integrated coolant jacket for forming a liquid-type cooling arrangement.

Embodiments of the internal combustion engine are advantageous in which the at least one heat conductor runs through the liquid-type cooling arrangement, such that the at least one heat conductor is impinged on with coolant at least in sections.

The above embodiment has proven to be particularly advantageous in the case of internal combustion engines whose liquid-type cooling arrangement has a so-called no-flow strategy.

Specifically, fast heating of the engine oil in order to reduce friction losses may basically also be aided by means of fast heating of the internal combustion engine itself, which in turn is assisted, that is to say forced, by virtue of as little heat as possible being extracted from the internal combustion engine during the warm-up phase.

In this respect, the warm-up phase of the internal combustion engine after a cold start is an example of an operating mode in which it is advantageous for as little heat as possible, preferably no heat, to be extracted from the internal combustion engine.

Control of the liquid-type cooling arrangement wherein the extraction of heat is reduced or stopped after a cold start in order to realize fast heating of the internal combustion engine may be realized by virtue of the circulation of the coolant being prevented. It is particularly advantageous if the coolant throughputs through the cylinder head and the cylinder block can be controlled independently of one another, in particular as the two components are subject to different thermal loading and exhibit different warm-up behavior. The coolant flows can then be controlled in a manner dependent on the respective warm-up behavior and the presently prevailing temperatures and aims.

The cooling strategy during the warm-up phase as discussed above has proven to be particularly advantageous in conjunction with the use, according to the invention, of a heat conductor. Specifically, if the at least one heat conductor runs through the liquid-type cooling arrangement, the coolant that circulates when the internal combustion engine has warmed up extracts heat from the heat conductor, which heat can then no longer be, or is no longer, introduced into the at least one bearing. At this point in time, it is also the case that no further heat is required, as the oil in the bearing has generally reached the operating temperature when the internal combustion engine has warmed up. Overheating of the oil and associated accelerated aging of the oil are thus prevented in a self-controlling, that is to say automatic fashion. By contrast, in the warm-up phase, when the circulation of the coolant is stopped or reduced, the heat transfer between coolant and the heat conductor is minimized, such that a maximum amount of heat can be and is introduced into the bearing.

In this respect, the liquid-type cooling arrangement with no-flow strategy provides demand-oriented control of the introduction of heat via the heat conductor. That section of the heat conductor which runs through the liquid-type cooling arrangement may be equipped with fins or the like in order to increase the heat transfer between coolant and heat conductor.

Instead of cooling fins, it would also be possible for that section of the heat conductor which runs through the liquid-type cooling arrangement to be provided with insulation, for example with a surface coating, in order that as little heat is possible is dissipated into the coolant during the heating-up process via the heat conductor.

The invention will be described in more detail below on the basis of two exemplary embodiments according to FIGS. 1A and 1B.

DETAILED DESCRIPTION

As required, detailed embodiments of the present disclosure are provided herein; however, it is to be understood that the disclosed embodiments are merely exemplary and that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1B:
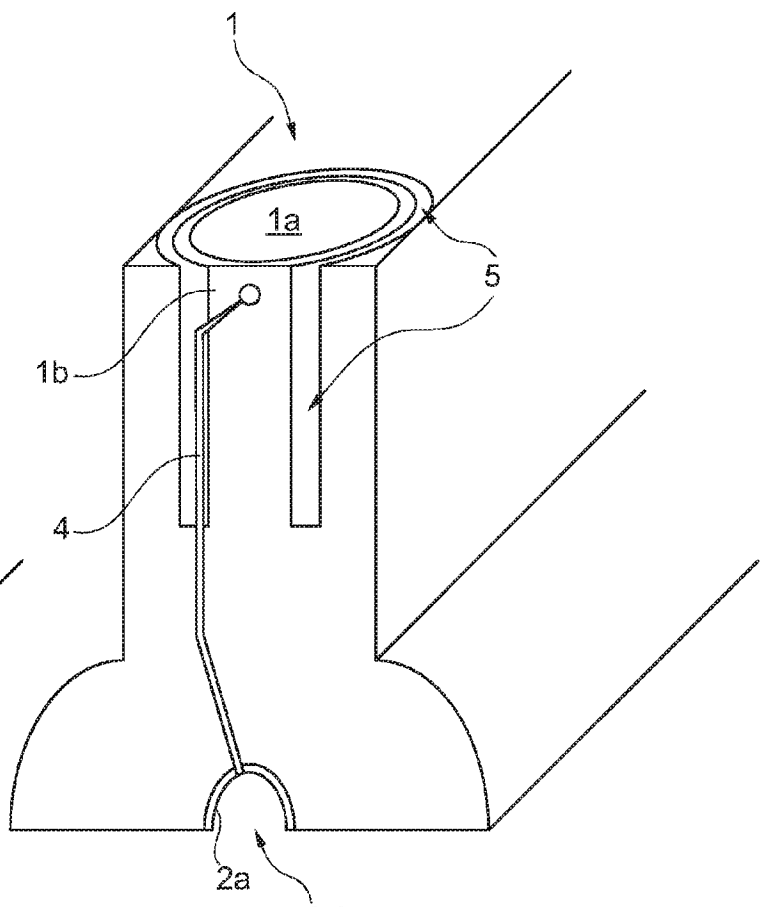
FIG. 1A schematically shows, in a perspective illustration and in cross section, the cylinder block of a first embodiment of the internal combustion engine with a bearing for holding a crankshaft, and FIG. 1B schematically shows, in a perspective illustration and in cross section, the cylinder block of a second embodiment of the internal combustion engine with a bearing for holding a crankshaft.
Figure 1A:
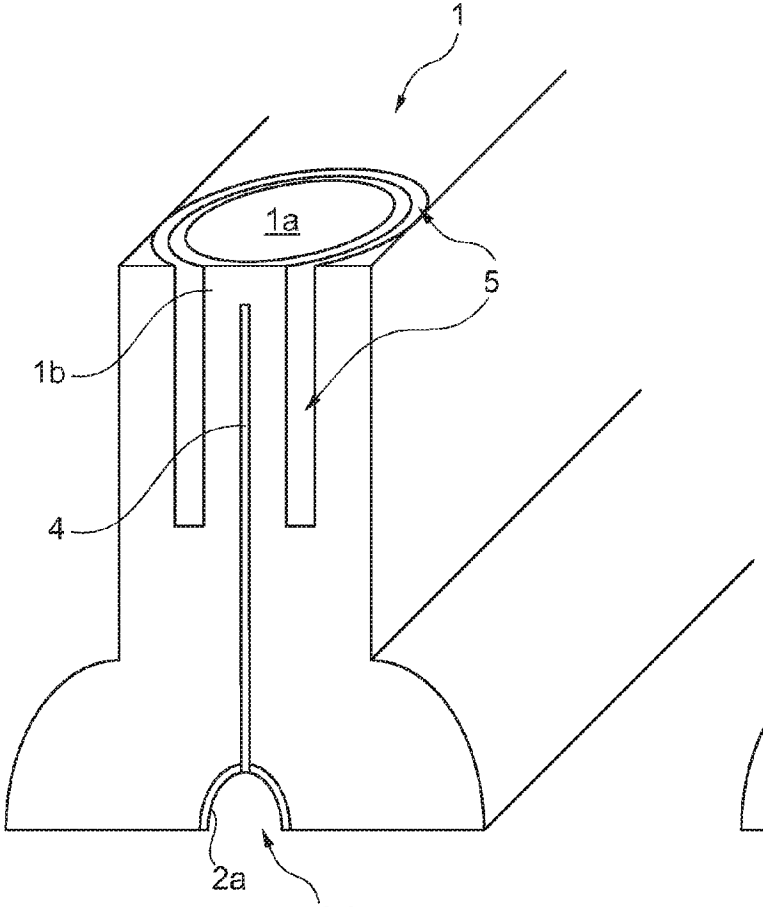

FIG. 1A schematically shows, in a perspective illustration and in cross section, the cylinder block 1 of a first embodiment of the internal combustion engine with a bearing 2 for holding a crankshaft.

The cylinder block 1, which serves as upper crankcase half, has at least two bearings 2 for the mounting of the crankshaft, of which half of a bearing 2 is illustrated in FIG. 1A. The receptacle 3 serves as a bearing cover 3 for holding the crankshaft. As an intermediate element between bearing cover 3 and crankshaft, a bearing shell 2*a* is provided which forms one half of a plain bearing 2. To supply oil to the bearing 2, an oil circuit with multiple oil-conducting lines is provided (not illustrated).

A heat conductor 4 runs between the bearing 2 and a thermally more highly loaded region of the cylinder block 1. The thermally more highly loaded region is, in the present case, a region between two cylinders 1*a*, in which region a so-called bore bridge 1*b* is formed which heats up quickly during the warm-up phase and exhibits high temperatures. Heat is conducted by means of the heat conductor 4 from the bore bridge 1*b* to the bearing shell 2*a* in order to heat oil situated in the bearing 2.

To form a liquid-type cooling arrangement 5, the cylinder block 1 has an integrated coolant jacket 5 which encases the cylinder bore 1*a*.

FIG. 1B schematically shows, in a perspective illustration and in cross section, the cylinder block 1 of a second embodiment of the internal combustion engine with a bearing 2 for holding a crankshaft. It is sought to explain only the differences in relation to the embodiment illustrated in FIG. 1A, for which reason reference is otherwise made to FIG. 1A. The same reference symbols have been used for the same components.

By contrast to the embodiment illustrated in FIG. 1A, it is the case in the variant illustrated in FIG. 1B that the heat conductor 4 runs, in sections, through the integrated coolant jacket 5 of the cylinder block 1.

The coolant, which circulates when the internal combustion engine has warmed up, of the liquid-type cooling arrangement 5 extracts heat from the heat conductor 4, such that less heat is introduced into the bearing 2. This also satisfies the heat requirement of the bearing 2 when the internal combustion engine has warmed up. In the warm-up phase, when the circulation of the coolant is prevented in accordance with a no-flow strategy, the heat transfer between coolant and heat conductor 4 is greatly reduced, such that a large amount of heat is introduced into the bearing 2.

Figure 2:
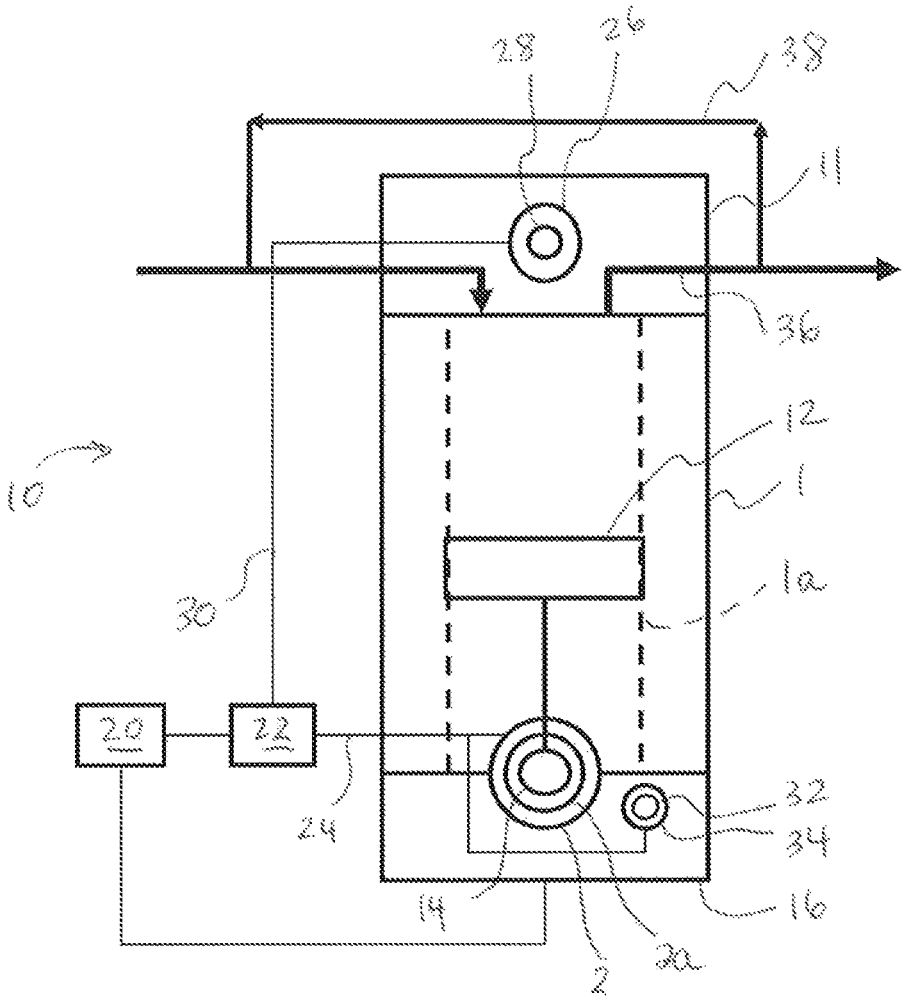
FIG. 2 schematically shows an internal combustion engine configured to implement the embodiments shown in FIGS. 1A and 1B.

FIG. 2 schematically shows an internal combustion engine 10 having a cylinder block 1 and a cylinder head 11 connected to one another in order to form the individual cylinders 1*a*. The piston 12 of each cylinder is articulatedly connected by means of a piston pin to a connecting rod, which in turn is movably mounted on the crankshaft 14. The crankshaft 14 is mounted in the crankcase and absorbs the connecting rod forces. Generally, and within the context of the present disclosure, the upper crankcase half is formed by the cylinder block 1. The crankcase is completed by the lower crankcase half 16 which can be mounted on the upper crankcase half and which serves as an oil pan. To hold and mount the crankshaft 14, at least two bearings 2 are provided in the crankcase. Bearing shells 2*a* may be arranged as intermediate elements between the crankshaft 14 and the bearings 2. To supply the crankshaft bearings 2 with oil, a pump 20 for delivering engine oil to the at least two crankshaft bearings 2 is provided, with the pump supplying engine oil via a supply line to a main oil gallery 22, from which ducts and oil-conducting lines 24 lead to the at least two bearings 2, and may, alternatively or in addition to the crankshaft bearings 2, supply oil to further bearings, for example the bearings 26 of a camshaft 28, which is generally mounted in a two-part so-called camshaft receptacle. The camshaft receptacle must normally also be supplied with lubricating oil, for which purpose a supply line 30 must be provided which, in the case of overhead camshafts 28, extends into the cylinder head 11. The internal combustion engine may have at least one further shaft as a balancing shaft 32 which is mounted in at least two bearings 34 in the crankcase. The internal combustion engine comprises an exhaust-gas discharge system 36 for discharging the exhaust gas from the at least one cylinder via an exhaust line which connects to the outlet opening of the cylinder and is at least partially integrated in the cylinder head. An exhaust-gas recirculation (EGR) arrangement 38 may run externally, that is to say outside the cylinder head, or else through the cylinder head.

While exemplary embodiments are described above, it is not intended that these embodiments describe all possible forms of the invention. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An internal combustion engine comprising:

a cylinder head;

a cylinder block connected to the cylinder head to form at least one cylinder, the cylinder block providing an upper crankcase half for holding a crankshaft in at least two crankshaft bearings;

at least one further shaft mounted in at least two shaft bearings;

an oil circuit having oil-conducting lines configured to supply oil to at least one of the bearings;

an exhaust-gas recirculation arrangement; and at least one elongated heat conductor element supported and surrounded by at least one of the block and the head, the at least one heat conductor element extending from a first end to a second end, the first end positioned directly adjacent to at least one of the bearings and the second end positioned directly adjacent to at least one thermally more highly loaded region of the internal combustion engine which, at least in a warm-up phase of the internal combustion engine, is at a higher temperature than the at least one bearing;

wherein the thermally more highly loaded region is a region of the cylinder block; and wherein the at least one heat conductor element comprises material having a higher thermal conductivity than the cylinder block.

2. The internal combustion engine of claim 1, wherein the oil circuit has a pump for delivering the oil, the pump being connected via a supply line to a main oil gallery from which ducts lead to the at least two crankshaft bearings.

3. The internal combustion engine of claim 1 wherein each crankshaft bearing comprises bearing shells.

4. The internal combustion engine of claim 1 wherein each of the crankshaft bearings is a rolling bearing.

5. The internal combustion engine of claim 1 wherein the at least one further shaft is a camshaft which is mounted in the cylinder head in the at least two shaft bearings.

6. The internal combustion engine of claim 1, wherein the at least one further shaft is a balancing shaft which is mounted in the at least two shaft bearings.

7. An internal combustion engine comprising:

a cylinder head;

a cylinder block connected to the cylinder head to form at least one cylinder, the cylinder block providing an upper crankcase half for holding a crankshaft in at least two crankshaft bearings;

at least one further shaft mounted in at least two shaft bearings;

an oil circuit having oil-conducting lines configured to supply oil to at least one of the bearings;

an exhaust-gas recirculation arrangement; and at least one elongated heat conductor element supported and surrounded by at least one of the block and the head, the at least one heat conductor element extending from a first end to a second end, the first end positioned directly adjacent to at least one of the bearings and the second end positioned directly adjacent to at least one thermally more highly loaded region of the internal combustion engine which, at least in a warm-up phase of the internal combustion engine, is at a higher temperature than the at least one bearing;

wherein the thermally more highly loaded region is a region of the cylinder head; and wherein the at least one heat conductor element comprises material having a higher thermal conductivity than the cylinder head.

8. The internal combustion engine of claim 7, wherein the thermally more highly loaded region of the cylinder head is further defined as a region of the exhaust-gas recirculation arrangement.

9. The internal combustion engine of claim 1 wherein the cylinder block and the cylinder head form at least two cylinders; and wherein the thermally more highly loaded region of the block is further defined as a region between the at least two cylinders.

10. The internal combustion engine of claim 1 further comprising a coolant-conducting liquid-type cooling arrangement;

wherein the at least one heat conductor element runs through the liquid-type cooling arrangement such that the at least one heat conductor is impinged on with coolant at least in sections.

11. The internal combustion engine of claim 10, wherein the cylinder block is equipped with an integrated coolant jacket for forming the liquid-type cooling arrangement.

12. An engine comprising:

a cylinder block forming an upper crankcase half holding a crankshaft in a crankshaft bearing;

an oil circuit having oil supply lines to the bearing; and a heatpipe supporting by the block and extending from a first condenser end at the bearing to a second evaporator end at a thermally loaded region of the engine at a higher temperature than the bearing during an engine warm-up phase.

13. The engine of claim 12 wherein the thermally loaded region is an interbore region between two cylinders;

wherein the block defines a cooling jacket; and wherein an intermediate section of the heatpipe runs through the cooling jacket such that an outer surface of the heatpipe is in contact with coolant contained therein.

14. The engine of claim 12 wherein the thermally loaded region of the engine is provided by one of a cylinder head, an exhaust-gas discharge system, and a region between two adjacent cylinders defined by the block.

15. The engine of claim 12 wherein the heatpipe has a two phase working medium hermetically encapsulated therein.

16. The internal combustion engine of claim 7 further comprising, an exhaust-gas discharge system for discharging exhaust gas from the at least one cylinder, wherein the thermally more highly loaded region of the cylinder head is further defined as a region of the exhaust-gas discharge system.

* * * * *